United States Patent [19]

Sears

[11] 4,155,503

[45] May 22, 1979

[54] SEPARATOR FOR SUSPENDED SOLIDS

[76] Inventor: Edward A. Sears, 113-174th Pl. NE., Bellevue, Wash. 98008

[21] Appl. No.: 914,916

[22] Filed: Jun. 12, 1978

[51] Int. Cl.[2] ..... B04B 11/08

[52] U.S. Cl. ..... 233/3; 233/23 R

[58] Field of Search ..... 233/1 R, 3, 7, 22, 21, 233/19 R, 23 R, 46, 47 R; 210/375

[56] References Cited

U.S. PATENT DOCUMENTS

| | | | |
|---|---|---|---|
| 3,424,375 | 1/1969 | Maurer | 233/7 X |
| 3,494,542 | 2/1970 | Craig et al. | 233/7 |
| 3,761,014 | 9/1973 | Carter | 233/20 A |
| 3,991,935 | 11/1976 | Henning | 233/47 R |

*Primary Examiner*—George H. Krizmanich

*Attorney, Agent, or Firm*—Wells, St. John & Roberts

[57] ABSTRACT

A centrifugal separator comprising an upright cylindrical drum having top and bottom walls which extend radially inward from its cylindrical side walls. The upper annular wall has a center aperture greater in diameter than the corresponding center aperture of the lower annular wall. A liquid slurry is delivered to the interior of the drum as it rotates, forcing separation of solid particles as they migrate outwardly toward the drum side walls. Excess liquid escapes over the top of the drum through the opening at the center of the upper annular wall. An independently rotatable scraper blade is coaxially mounted with the drum and is located adjacent the interior side walls. The scraper blade can be independently braked to assist in removing solid materials from the rotating side walls while drum rotation is being terminated.

8 Claims, 3 Drawing Figures

SEPARATOR FOR SUSPENDED SOLIDS

BACKGROUND OF THE INVENTION

The present separator was designed specifically for use in a reclaiming system for foundry sand of the type generally described in U.S. Pat. No. 4,008,856. It is applicable to other applications as well. The disclosure of that patent, which is hereby incorporated by reference, includes a description of a predecessor centrifugal separator, which is shown in FIGS. 4 and 7 of the earlier patent disclosure. This disclosure pertains to an improvement in the earlier separator.

While centrifugal separation under cicumstances described in U.S. Pat. No. 4,008,856 was effective, difficulty was encountered in the removal of solid materials from the separator drum. The present improvement is designed to facilitate such removal without requiring manual scraping of the drum interior.

DESCRIPTION OF THE PREFERRED EMBODIMENT

Figure 2:
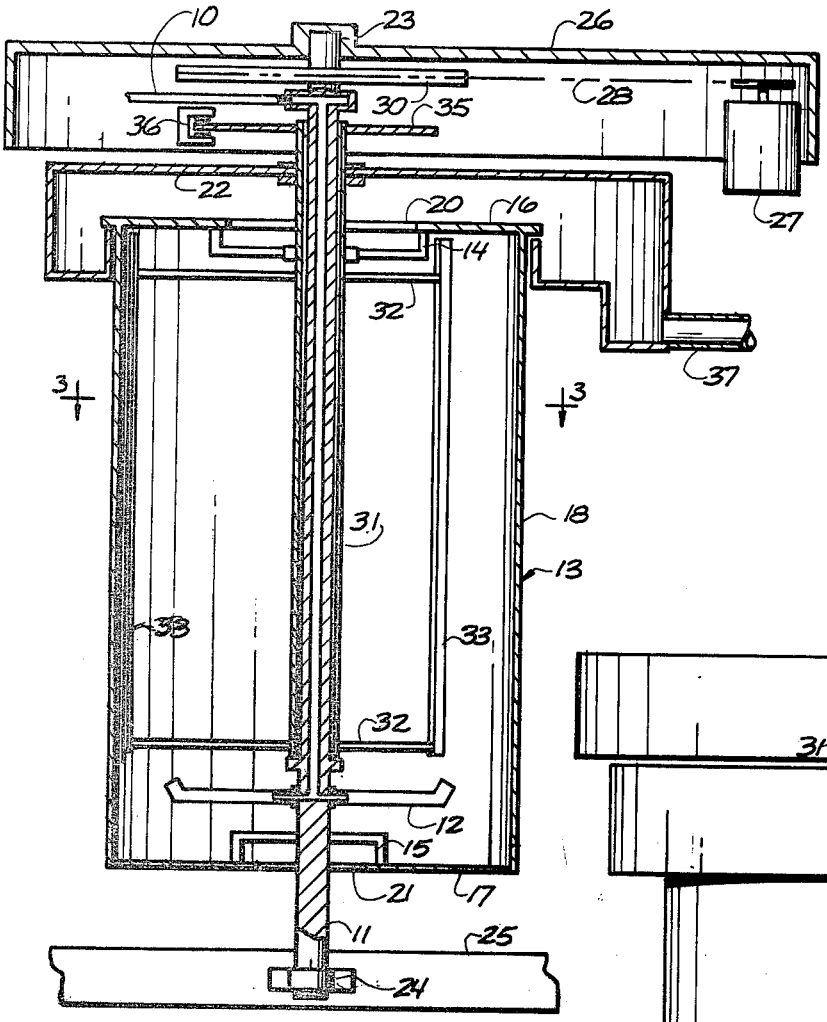
FIG. 2 is a vertical sectional view through the separator; taken along line 2—2 in FIG. 3.
Figure 3:
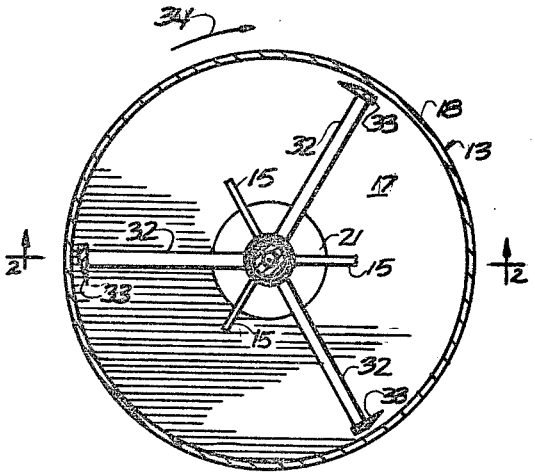
FIG. 3 is a sectional view taken along line 3—3 in FIG. 2.
Figure 1:
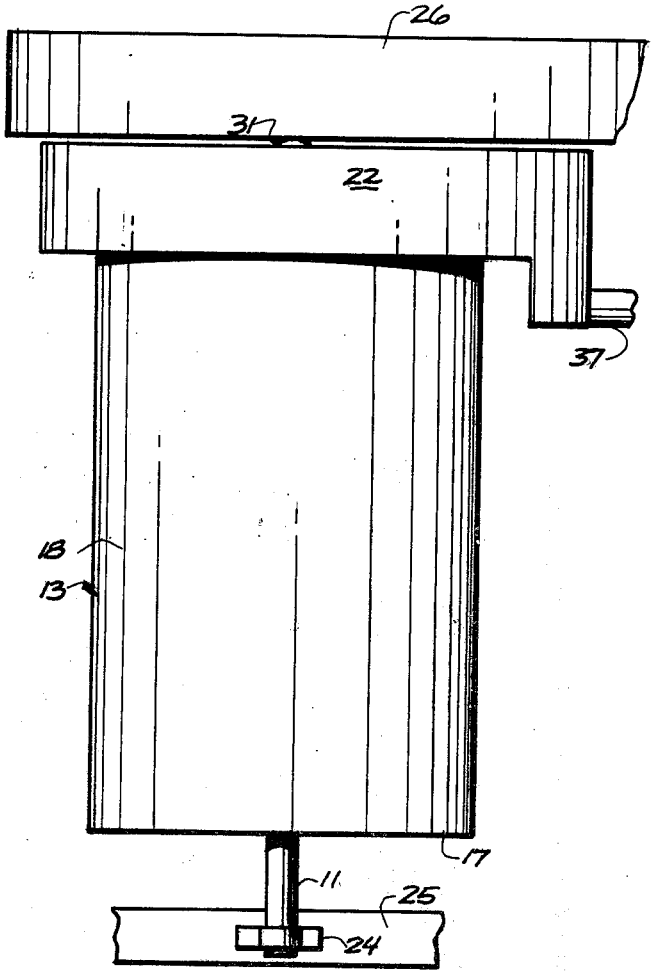
FIG. 1 is a side elevation view of the separator.

FIGS. 1 through 3 illustrate the general details of a separator incorporating the present improvements. The separator is designed to remove suspended particles supplied to it through a conduit 10. As an example of such a slurry, it might be composed of fine particles suspended in water, as in the waste slurry described in U.S. Pat. No. 4,008,856, which relates to the reclaiming of used foundry sand.

The slurry is pumped through the conduit 10, which is connected to a suitable packing in hydraulic communication with the hollow center of a main vertical shaft 11. The lower end of the hollow portion of shaft 11 is in hydraulic communication with radial arms 12 having suitable nozzles at their outer ends for discharging the slurry in an axial direction as shaft 11 is rotated. The arms 12 are fixed to shaft 11 and rotate in unison with the shaft The support shaft 11 is located within a cylindrical separator drum 13. Drum 13 is coaxially mounted about shaft 11 by upper and lower spider frames 14, 15. The lower frame 15 is fixed to shaft 11. The upper frame 14 is freely rotatable about a tube 31 described below. Drum 13 rotates in unison with shaft 11. Drum 13 has liquid impermeable side walls in a cylindrical configuration. It also includes annular top and bottom walls 16, 17. The walls 16, 17 join the side walls 18 and extend radially inward from the side walls 18 in a direction perpendicular to the vertical axis along the center of shaft 11.

The upper annular wall 16 has a center aperture defined by a circular edge 20. The lower annular wall 17 also has a center aperture defined by a circular edge 21. Both edges 20, 21 are formed coaxially about the axis of shaft 11. The radius of the circular edge 20 and the opening formed thereby is greater than the corresponding radius and opening at edge 21.

Shaft 11 is supported by upper and lower bearings 23, 24 on a stationary frame. A portion of the frame is shown at 25 for support of lower bearing 24. The upper portion of the assembly is located within a protective cover 26 which includes the upper bearing 23. Drum 13 is powered by a motor drive unit 27 through conventional belts or chains indicated diagrammatically at 28 and operatively connected to a sprocket or pulley shown at 30. The sprocket or pulley 30 is fixed to the upper end of shaft 11.

In this improvement, an independently rotatable scraper blade assembly is mounted coaxially about the axis of shaft 11 within the confines of drum 13. This assembly comprises a tube 31 freely rotatable about the shaft 11. Tube 31 is provided with radial arms 32 which support upright scraper blades 33 located adjacent to the inner surfaces of the side walls 18 about drum 13. Each blade 33 is tapered in a direction opposite to the intended direction of rotation of drum 13, which is indicated by the arrow 34. (FIG. 3).

The upper end of tube 31 is provided with a circular disk 35 fixed to it. Disk 35 is engageable by a conventional disk brake mechanism shown at 36. The brake mechanism 36 is capable of retarding or stopping rotation of disk 35 and shaft 31 when activated.

In use, the liquid slurry is delivered through shaft 11 during rotation of drum 13. The drum 13 is rotated at a relatively fast rate. As an example, drum approximately 16 inches in diameter might be rotated at 800 revolutions per minute. Incoming liquid materials are held against the inner cylindrical walls of the drum 13 by centrifugal force. The liquid will basically form a cylinder extending inwardly from the side walls 18 and confined by the annular walls 16, 17. The inner radius of the cylinder will be approximately the radius of the circular edges 20 at the top of drum 13. Because the radius of the opening at the upper wall 16 is greater than that of the opening at the lower wall 17, excess liquid will escape outwardly over the top of drum 13 within the cover assembly 22. This liquid will then flow by gravity through an exit conduit shown at 37.

The solid materials suspended in the slurry fed to shaft 11 are collected along the cylindrical side walls 18 of drum 13. The axial direction of the incoming suspension at the outer ends of discharge arms 12 serves to direct the incoming slurry in an upward spiral along the inner surfaces of walls 18. Thus, the incoming liquid does not disrupt the material about the interior of drum 13.

Drum 13 is intermittently cleaned by terminating the delivery of slurry at conduit 10 and terminating rotation of shaft 11 by means of the drive unit 27. In an earlier version, the drive unit 27 incorporated a brake mechanism to stop rotation of the drum 13 rapidly, allowing the moving liquid to wash about the drum walls as it falls through the opening in the lower wall 17. The purpose was to carry with it solid materials collected within the drum 13.

Many solid materials become so tightly caked about the interior of the drum 13 that they are not removed by the hydraulic action of the rotating fluid. For this reason, the blades 33 are utilized to mechanically scrape the material from the interior side wall surfaces. As the separator drum 13 is normally rotated, the brake 36 is deactivated, allowing the blades 33 to freely rotate in unison with drum 13 as the solid material builds up within it. However, the brake controls are interconnected with the drive unit controls, so that termination of operation of the drive unit 27 automatically activates brakes 36. As the rotation of drum 13 continues due to inertia, the blades 33 are prevented from rotating. The drum 13 and liquid within it will therefore rotate past the stationary blades 33, and solid material will thereby be dislodged from the interior surfaces of side walls 18. Again, the moving liquid will flush the solid materials downwardly through the opening in walls 17, where they can be collected within a receptacle beneath the drum 13 (not shown).

Modifications can be made with respect to the details of the device as shown, and still lie within the basic disclosure set out herein. For this reason, only the following claims are set out as a description of the invention.

Having described my invention, I claim:

1. A batch separator for solid material suspended in a liquid medium, comprising:

a cylindrical drum having liquid-impervious side walls rotatably mounted for free rotational movement about an upright axis;

a liquid-impervious first annular wall joined to one end of the drum side walls and extending inwardly from the side walls to a central aperture centered about said upright axis;

a liquid-impervious second annular wall joined to the remaining end of the drum side walls;

interruptible drive means operatively connected to said drum for rotating said drum about said upright axis at a rotational speed such that the liquid within the drum is confined against the side walls;

scraper blade means comprising a plurality of upright blades parallel to said axis and adjacent the interior of the side walls, said blades being rotatably journalled with respect to said drum about upright axis for free rotational movement relative to the drum;

brake means operably connected to said scraper blade means for selectively fixing the position of the scraper blade means about said upright axis when said brake means is activated;

supply means for directing incoming liquid suspension to the drum interior between said annular walls during rotation of the drum by said interruptible drive means;

annular collector means nonrotatably mounted about the one end of the drum for receiving liquid discharged through the central aperture during drum rotation;

and means for receiving material from within the drum side walls when drum rotation has been terminated.

2. A separator as set out in claim 1 further comprising:

brake control means operatively connected to said interruptible drive means and said brake means for deactivating said brake means during drum rotation and for activating said brake means when operation of said interruptible drive means has been terminated.

3. A separator as set out in claim 1 wherein said scraper blade means further comprises:

a tube freely rotatable about said upright axis;

and radial arms fixed between said tube and said blades.

4. A separator as set out in claim 1 wherein said scraper blade means further comprises:

a tube freely rotatable about said upright axis;

and radial arms fixed between said tube and said blades;

each of said blades being tapered in a direction opposite to the intended direction of rotation of said drum about said upright axis.

5. A batch separator for solid material suspended in a liquid medium, comprising:

a cylindrical drum having liquid-impervious side walls rotatably mounted for free rotational movement about an upright axis;

a liquid-impervious first annular wall joined to one end of the drum side walls and extending inwardly from the side walls to a first central aperture centered about said upright axis;

a liquid-impervious second annular wall joined to the remaining end of the drum side walls and extending inwardly from the side walls to a second central aperture centered about said upright axis;

said first central aperture having a radius greater than the radius of said central aperture;

interruptible drive means operatively connected to said drum for rotating said drum about said upright axis at a rotational speed such that the liquid within the drum is confined against the side walls and cannot exit through the second aperture during drum rotation;

scraper blade means comprising a plurality of upright axial blades parallel to said axis and adjacent the interior of the side walls, said blades being rotatably journalled with respect to said drum about said upright axis for free rotational movement relative to the drum;

brake means operably connected to said scraper blade means for selectively fixing the position of the scraper blade means about said upright axis when said brake means is activated;

supply means for directing incoming liquid suspension to the drum interior between said annular walls during rotation of the drum by said interruptible drive means;

annular collector means nonrotatably mounted about the one end of the drum for receiving liquid discharged through the first aperture during drum rotation;

and means associated with the second aperture of the drum for receiving material discharged through the second aperture following termination of drum rotation.

6. A separator as set out in claim 5 further comprising:

brake control means operatively connected to said interruptible drive means and said brake means for deactivating said brake means during drum rotation and for activating said brake means when operation of said interruptible drive means has been terminated.

7. A separator as set out in claim 5 wherein said scraper blade means further comprises:

a tube freely rotatable about said upright axis;

and radial arms fixed between said tube and said blades.

8. A separator as set out in claim 7 wherein said scraper blade means further comprises:

a tube freely rotatable about said upright axis;

and radial arms fixed between said tube and said blades;

each of said blades being tapered in a direction opposite to the intended direction of rotation of said drum about said upright axis.

* * * * *